United States Patent [19]

Lin

[11] Patent Number: 5,046,287

[45] Date of Patent: Sep. 10, 1991

[54] WET GRINDING TYPE OF GRINDER WITH IMPROVED MATERIAL DISCHARGE MECHANISM

[76] Inventor: Chao-Tong Lin, 3F., No. 1-5, Lane 101, Ta Tung S. Rd., San Chung City, Taipei Hsien, Taiwan

[21] Appl. No.: 658,147

[22] Filed: Feb. 20, 1991

[51] Int. Cl.[5] ..... B24B 31/108; B24B 31/16

[52] U.S. Cl. ..... 51/163.1; 51/164.1; 51/163.2

[58] Field of Search ..... 51/164.1, 163.2, 163.1, 51/313, 316, 7, 17

[56] References Cited

U.S. PATENT DOCUMENTS

| | | | |
|---|---|---|---|
| 4,030,247 | 6/1977 | Grund et al. | 51/164.1 |
| 4,363,194 | 12/1982 | Balz | 51/163.1 |

FOREIGN PATENT DOCUMENTS

| | | | |
|---|---|---|---|
| 4635838 | 9/1968 | Japan | 51/313 |
| 0107769 | 7/1982 | Japan | 51/163.2 |
| 0114357 | 7/1982 | Japan | 51/163.2 |
| 0051066 | 3/1983 | Japan | 51/164.1 |
| 0899331 | 1/1982 | U.S.S.R. | 51/7 |
| 1495082 | 7/1989 | U.S.S.R. | 51/163.1 |

*Primary Examiner*—Robert A. Rose
*Attorney, Agent, or Firm*—Varndell Legal Group

[57] ABSTRACT

A grinder of the type comprising a grinding cylinder for containing liquid grinding compound and a centrifugal disc to centrifugalize said liquid grinding compound for performing grinding operation, the improvement including a grinding cylinder automatic lifting mechanism controlled by a timer to automatically drive a motor to drive a linkage to automatically lift said grinding cylinder from said centrifugal disc for discharging liquid grinding compound and processed working pieces out of said grinding cylinder. A water circulation system is provided to circulate clean water through said grinding cylinder for cleaning purpose.

1 Claim, 2 Drawing Sheets

WET GRINDING TYPE OF GRINDER WITH IMPROVED MATERIAL DISCHARGE MECHANISM

BACKGROUND OF THE INVENTION

The present invention relates to wet grinding type of grinders and relates more particularly to an improved material discharge mechanism for discharging grinding materials from a grinder which utilizes liquid grinding compound for grinding.

Regular wet grinding type of grinders generally include a centrifugal disc to centrifugalize liquid grinding compound in a grinding cylinder for performing grinding operation so as to polish the surface of the working pieces put therein. In the known structure of wet grinding type of grinders, the grinding cylinder is provided with a discharge port for discharging liquid grinding compound and working pieces. During discharge process, bigger working pieces may stick in the discharge port easily. Further. each time after grinding process is completed, the grinding cylinder must be washed and cleaned. Because clean water must be separately filled into the grinding cylinder, washing the grinding cylinder is not easy. The present invention has been accomplished to eliminate the aforesaid disadvantages.

SUMMARY OF THE INVENTION

According to a first aspect of the present invention, a wet grinding type of grinder includes a grinding cylinder automatic lifting mechanism which automatically lifts a grinding cylinder from centrifugal disc each time after grinding process is completed, by means of the operation of a motor controlled by a timer, so that finished working pieces and liquid filed of waste grinding compound can be automatically discharged. The lifting mechanism includes a motor to drive a main screw rod to rotate permitting a three-arm supporting member to move upwards or downwards on the main screw rod according to the revolving direction of the motor. The grinding cylinder is coupled to the three-arm supporting member through three columns. Therefore, rotating the motor causes the main screw rod to carry the three-arm supporting member to move the grinding cylinder from or toward the centrifugal disc via the three columns. Limit switches are respectively set at two opposite locations to limit the moving range of the three-arm supporting member and the grinding cylinder.

According to a second aspect of the present invention, a wet grinding type of grinder includes a water circulation system which automatically drives a water pump to pump clean water into the grinding cylinder for wash each time after grinding process is completed. A water filter device is provided to purify discharged water for further use.

DETAILED DESCRIPTION OF THE PREFERRED EMBODIMENT

Figure 1:
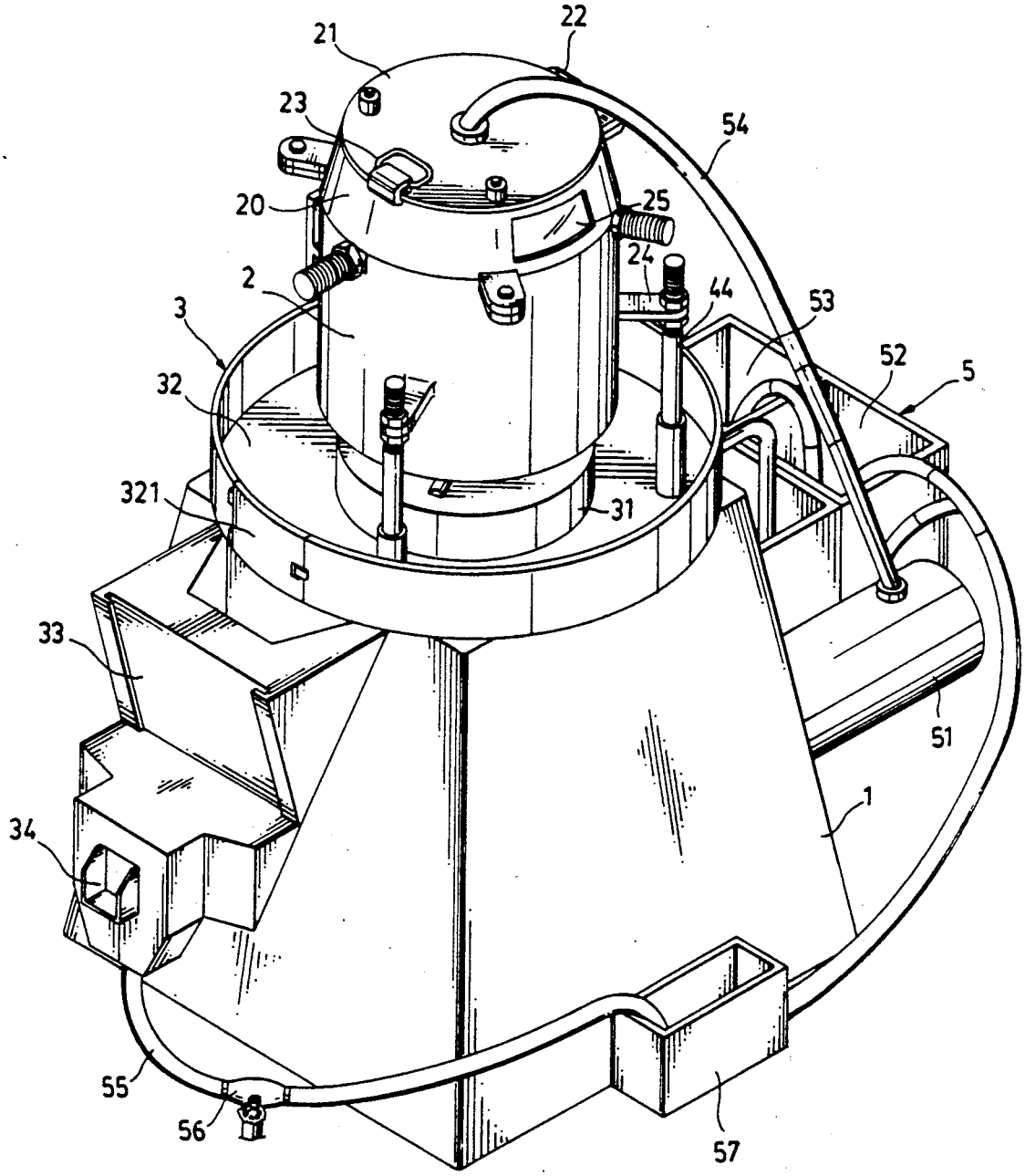
FIG. 1 is a perspective view of the preferred embodiment of the present invention.
Figure 2:
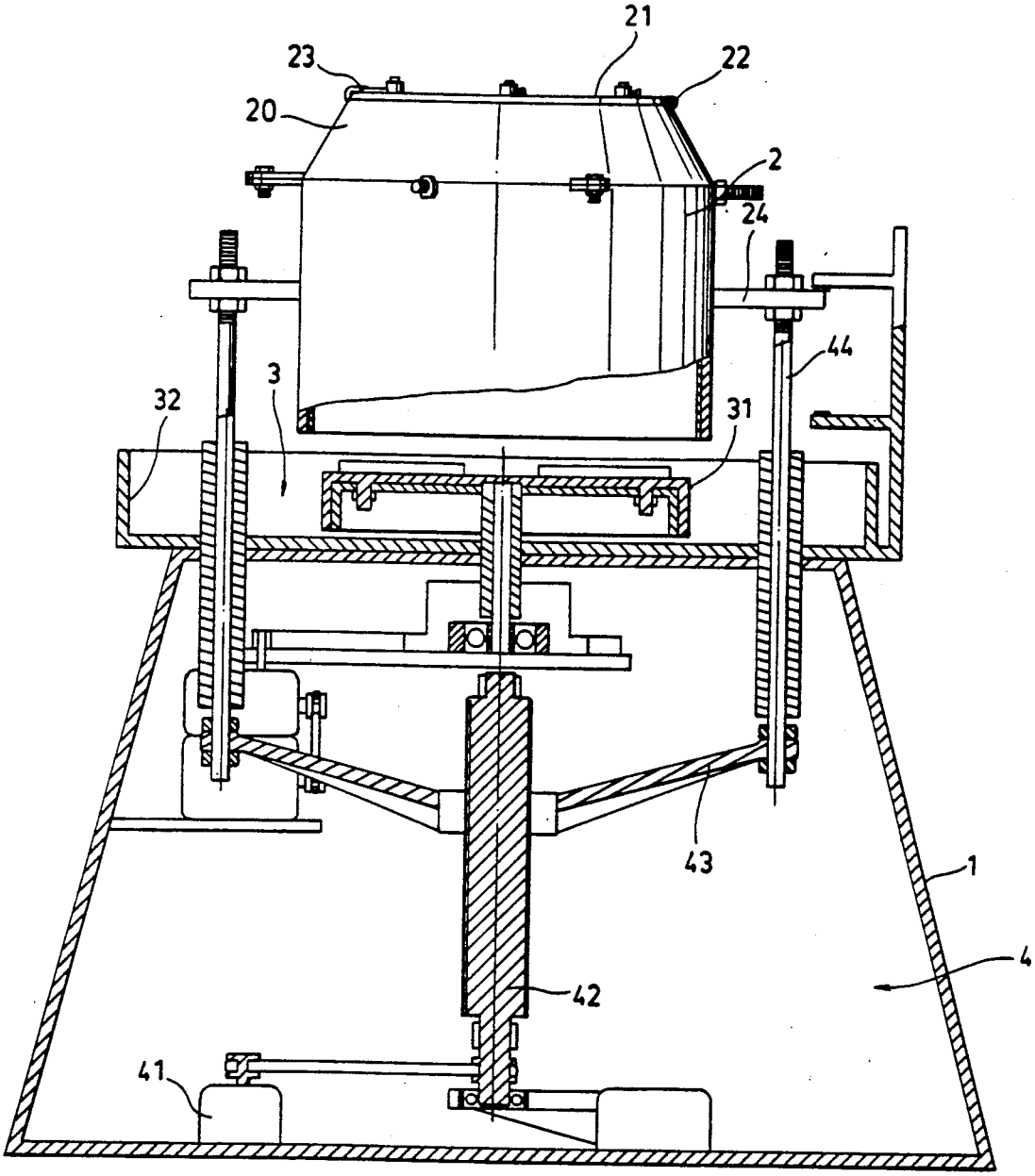
FIG. 2 is a sectional view of the preferred embodiment of the present invention showing the internal structure thereof.

Referring to FIGS. 1 and 2, a wet grinding type of grinder constructed according to the present invention is generally comprised of a machine base 1, a grinding cylinder 2, a centrifugal disc material discharge mechanism 3, a grinding cylinder automatic lifting mechanism 4, and a water circulation system 5.

The grinding cylinder 2 is mounted on the top of the machine base 1, having a tapered ring 20 at the top covered with an upper cap 21. The upper cap 21 is pivotably secured to the tapered ring 20 by a hinger means 22, having a lifting eye 23 made thereon at a location opposite to its connecting end to said hinge means. Through the lifting eye 23, the upper cap 21 can be conveniently opened for putting grinding compound and working pieces inside the grinding cylinder 2. A filling pipe 54 from the water circulation system 5 is connected to the upper cap 21 for filling grinding compound and clean water into the grinding cylinder 2. The grinding cylinder 2 has three lugs 24 transversely disposed at the outside around the peripheral thereof and spaced from one another at equal interval. The three lugs 24 of the grinding cylinder 2 are respectively connected to three columns 44 which are vertically set in the machine base 1. The tapered ring 20 has a view window 25 on the outer wall thereof through which a operator can clearly see the inside of the grinding cylinder 2.

The centrifugal disc material discharge mechanism 3 includes a circular material discharge pan 32 for holding the centrifugal disc 31 which is set in the grinding cylinder 2 at the bottom to centrifugalize the liquid field grinding compound contained in the grinding cylinder 2. When the grinding cylinder 2 is lifted by the automatic grinding cylinder lifting mechanism 4, materials contained in the grinding cylinder 2 are discharged into the material discharge pan 32. The material discharge pan 32 has a discharging door 321 connected to a hopper means 33 which is further connected to an outlet port 34. Inside the hopper means 33 there are provided screens and conducts for separating finished working pieces from grinding compound and slag. Therefore, after each grinding process is completed, well finished working pieces are delivered out of the grinder from the grinder cylinder 2 through the outlet port 34 via the discharging door 321 and the hopper means 33. Discharged liquid from the grinding cylinder 2 is returned to the water circulation system 5 via a return pipe 55 (see FIG. 1).

The grinding cylinder automatic lifting mechanism 4 is fastened in the machine base 1, comprising a motor 41, a main screw rod 42 driven by said motor 41, a three-arm supporting member 43 mounted on said main screw rod 42. When the motor 41 is turned on, the three-arm supporting member 43 is forced to move upwards or downwards on the main screw rod 42. Because the three columns 44 have each a bottom end connected to the three-arm supporting member 43 and an opposite end connected to the lugs 24 of the grinding cylinder 2. Rotating the motor 41 causes the three-arm supporting member 43 to lift the grinding cylinder 2 from the centrifugal disc 31 permitting the materials contained therein to discharge into the material discharge pan 32 (see FIG. 2).

The water circulation system 5 is controlled by a timer to drive a water pump 51 to pump clean water from a water tank 52 or grinding compound from a chemical tank 53 into the grinding cylinder 2 via the filling pipe 54. Each time after grinding, clean water is pumped into the filling pipe 54 to wash the grinding cylinder 2. After discharge, drain liquid is guided into the return pipe 55 which is further connected to a three-way pipe 56 through which drain liquid can be drained off or guided to the water tank 52 via a water filter 57 for further circulation.

Each time after grinding process is completed, the motor 41 is turned on to drive the main screw rod 42 to carry the three-arm supporting member 43 to move upwards so as to lift the grinding cylinder 2 from the centrifugal disc 31 permitting liquid grinding compound and working pieces to discharge, by means of the rotary motion of the centrifugal disc 31 before it is stopped, into the material discharge pan 32. Finished working pieces from the material discharge pan 32 are further separated by the screens in the hopper means 33 and guided to discharge through the outlet port 34 while discharged liquid is guided into the return tube 55 and then drain off through the three-way pipe 56. Then, clean water is pumped from the water tank 52 into the filling pipe 54 for washing the grinding cylinder 2. After wash, discharged water is guided by the return pipe 55 into the water filter 57 for purification from which purified water is sent to the water tank 52 for further circulation.

I claim:

1. A grinder of the type comprising a centrifugal disc mounted on the top of a base to centrifugal liquid grinding compound in a grinding cylinder for grinding, a grinding cylinder automatic lifting mechanism to automatically lift said grinding cylinder from said centrifugal disc, a centrifugal disc material discharge mechanism to deliver liquid grinding compound and working pieces from said grinding cylinder out of said base, and a water circulation system to alternatively pump liquid grinding compound and clean water into said grinding cylinder for grinding operation or washing; characterized in that:

said grinding cylinder automatic lifting mechanism comprises a main screw rod vertically fastened in said base and driven to rotate by a motor, a three-arm supporting member mounted on said main screw rod, and three columns respectively connected between said three-arm supporting member and said grinding cylinder, and wherein rotating said motor causes said three-arm supporting member to move upwards or downwards on said main screw rod so as to further drive said columns to lift said grinding cylinder from said centrifugal disc for material discharge operation or carry said grinding cylinder to cover said centrifugal disc for grinding operation.

* * * * *